US005625856A

United States Patent [19]

Kohda et al.

[11] Patent Number: 5,625,856

[45] Date of Patent: Apr. 29, 1997

[54] IMAGE FORMING SOLUTION APPLICATOR, IMAGE FORMING SOLUTION APPLICATION UNIT, AND METHOD OF MANUFACTURING APPLICATOR

[75] Inventors: Hiroyuki Kohda; Kohji Uchida; Atsuhiro Doi, all of Kanagawa, Japan

[73] Assignee: Fuji Photo Film Co., Ltd., Kanagawa, Japan

[21] Appl. No.: 681,992

[22] Filed: Jul. 30, 1996

[30] Foreign Application Priority Data

Aug. 4, 1995 [JP] Japan ..... 7-200014

[51] Int. Cl.[6] ..... G03D 5/06

[52] U.S. Cl. ..... 396/604; 355/27

[58] Field of Search ..... 396/604, 605, 396/606, 607, 608, 609, 610; 355/27, 100, 106

[56] References Cited

U.S. PATENT DOCUMENTS 3,786,736 1/1974 Neeb et al. ..... 396/609

3,827,906 8/1974 Takats ..... 396/604

3,912,833 10/1975 Becker ..... 396/604

4,252,598 2/1981 Bachelder ..... 396/606

*Primary Examiner*—A. A. Mathews

*Attorney, Agent, or Firm*—Sughrue, Mion, Zinn, Macpeak & Seas

[57] ABSTRACT

An image forming solution applicator which is formed of a flexible, porous material, and which can absorb and hold an image forming solution supplied from an external portion, and from which absorbed and held image forming solution flows out due to the applicator contacting an image recording material, and which applies the image forming solution to the image recording material by moving while contacting the image recording material. An average porosity of a portion of the applicator to which the image forming solution is supplied is greater than an average porosity of a portion of the applicator which contacts the image recording material. Accordingly, supplied image forming solution smoothly penetrates into the applicator, and is quickly absorbed and stably retained by the applicator.

21 Claims, 6 Drawing Sheets

IMAGE FORMING SOLUTION APPLICATOR, IMAGE FORMING SOLUTION APPLICATION UNIT, AND METHOD OF MANUFACTURING APPLICATOR

BACKGROUND OF THE INVENTION

1. Field of the Invention

The present invention relates to an image forming solution applicator, an image forming solution application unit and a method of manufacturing an applicator, the applicator applying an image forming solution to an image recording material in order to obtain an image on the image recording material.

2. Description of the Related Art

In an image recording device, a photosensitive material is exposed and thereafter is superposed with an image receiving material, and heat development transfer is carried out so as to obtain an image on the image receiving material.

In order to improve the rate of heat development transfer, a transfer assistant (an image forming solution) such as water or the like is applied to the photosensitive material after exposure, before heat development transfer.

A device for applying an image forming solution (an image forming solvent) to a photosensitive material has been proposed in which an image forming solution is filled in a container, and a sponge or felt is provided at the bottom wall of the container. The sponge or the felt is made to contact a photosensitive material which is being held horizontally, and is moved along the photosensitive material together with the container while contacting the photosensitive material. In this way, the image forming solution is applied to the photosensitive material.

The sponge absorbs and holds the image forming solution within the container. The image forming solution flows out onto the photosensitive material due to the sponge contacting the photosensitive material. However, the absorption of the image forming solution within the container by the sponge, i.e., the supply of the image forming solution within the container to the sponge, must be stabilized in order to realize uniform, smooth and rapid application of the image forming solution onto the photosensitive material.

SUMMARY OF THE INVENTION

In view of the aforementioned, an object of the present invention is to provide an image forming solution applicator, an image forming solution application unit and a method of manufacturing an applicator in which, during the application of an image forming solution, the image forming solution within a container can be stably supplied to an application portion and uniform, smooth and rapid application is made possible, and further, in which manufacturing of the applicator is easy.

A first aspect of the present invention is an image forming solution applicator which is formed of a flexible, porous material, and which can absorb and hold an image forming solution supplied from an external portion, and from which the absorbed and held image forming solution flows out due to the applicator contacting an image recording material, and which applies the image forming solution to the image recording material by moving relatively to the image recording material while contacting the image recording material, wherein an average porosity of a first region of the applicator, to which first region the image forming solution is supplied, is greater than an average porosity of a second region of the applicator, which second region contacts the image recording material.

In accordance with the above-described first aspect, the image forming solution supplied to the applicator from an external portion is supplied from the first region whose average porosity is large (i.e., from the inner portion which does not contact the image recording material), and is absorbed by the applicator. The absorbed image forming solution is applied to the image recording material by the applicator and the image recording material moving relatively to one another while the applicator contacts the image recording material. For example, the image recording material may be fixed and the applicator moved, or conversely, the applicator may be fixed and the image recording material may be moved.

Here, the average porosity of the first region to which the image forming solution is supplied is greater than the average porosity of the second region (i.e., the outer side) which contacts the image recording material. Therefore, the supplied image forming solution penetrates smoothly and rapidly into the applicator and can be absorbed rapidly and held stably thereby. Accordingly, the image forming solution can be applied uniformly to the image recording material, and a high quality image can be obtained.

The second aspect of the present invention is an image forming solution applicator which, in the image forming solution applicator of the first aspect, the applicator is an elongated body which extends in a direction substantially orthogonal to a direction in which the applicator moves while contacting the image recording material, the elongated body being formed by a first portion which is elongated and includes the first region and a second portion which is elongated and includes the second region, and when the image forming solution is supplied from the external portion, air bubbles remaining in an interior portion of the applicator are expelled from longitudinal direction end surfaces of the first portion and the second portion.

In accordance with the above-described aspect, when the image forming solution is supplied from an external portion, the air bubbles remaining within the applicator are quickly discharged to the exterior from the longitudinal direction end surfaces of the applicator as the image forming solution is supplied to the applicator. Accordingly, the absorption and retention of the image forming solution in the application is not hindered, and the image forming solution penetrates smoothly and rapidly into the applicator and is quickly absorbed and stably retained thereat.

A third aspect of the present invention is an image forming solution application unit, comprising: a container movable relatively to an image recording material along the image recording material, and housing an image forming solution for obtaining an image on the image recording material, and having, at a bottom wall of the container which bottom wall opposes the image recording material, an applicator for applying the image forming solution to the image recording material; and a communicating/supplying portion provided at the bottom wall of the container and supplying the image forming solution within the container directly to the applicator, wherein the applicator is formed of a flexible, porous material and can absorb and hold the image forming solution supplied from the communicating/supplying portion, the absorbed and held image forming solution flowing out from the applicator due to the applicator contacting the image recording material, the applicator applying the image forming solution to the image recording material by moving relatively to the image recording material while contacting the image recording material, and an average porosity of a first region of the applicator, to which first region the image forming solution is supplied, is greater than an average porosity of a second region of the applicator, which second region contacts the image recording material.

In accordance with the above-described third aspect, the image forming solution within the container is supplied via the communicating/supplying portion directly to the section of the applicator whose average porosity is large, i.e., the first region (specifically, the inner portion which does not contact the image recording material). The supplied and absorbed image forming solution is applied to the image recording material from the applicator by the applicator contacting the image recording material. Moreover, the image forming solution is applied to the image recording material by the applicator (together with the container) and the image recording material moving relatively to one another along the image recording material with the applicator contacting the image recording material. For example, the image recording material may be fixed and the applicator may be moved, or conversely, the applicator may be fixed and the image recording material may be moved.

Here, in the application unit, the image forming solution is directly supplied by the communicating/supplying portion to the first region of the applicator whose average porosity is large. Therefore, the supplied image forming solution smoothly and rapidly penetrates into the applicator, and is quickly absorbed and stably held by the applicator. Accordingly, the image forming solution can be applied uniformly to the image recording material, and a high quality image is obtained.

In an image forming solution application unit of the fourth aspect, the communicating/supplying portion of the image forming solution application unit of the third aspect includes a liquid introducing member for supplying the image forming solution within the container to the first region of the applicator.

In accordance with the above-described aspect, the image forming solution within the container is directly supplied to the first region of the applicator via the liquid introducing member. Therefore, the image forming solution can be supplied to the applicator even more reliably and stably. The image forming solution penetrates smoothly and quickly into the applicator, and is absorbed rapidly and retained stably thereby.

In an image forming solution application unit of the fifth aspect, the image forming solution application unit of either the third or the fourth aspect is provided with an air hole which introduces outside air directly into the container so as to handle the decrease in pressure within the container which accompanies the supplying of the image forming solution within the container to the applicator.

In accordance with the above-described structure, when the image forming solution is absorbed by the applicator and applied to the image recording material from the applicator, the amount of the image forming solution within the container decreases in accordance with this application, and the pressure within the container decreases. However, outside air is introduced into the container through the air hole and compensates for the reduction in pressure.

Accordingly, the image forming solution within the container is always supplied stably to the applicator, and the image forming solution can be applied uniformly to the image recording material so that a high quality image is obtained.

A sixth aspect of the present invention is a method of manufacturing an image forming solution applicator which is formed of a flexible, porous material, and which can absorb and hold an image forming solution supplied from an external portion, and from which the absorbed and held image forming solution flows out due to the applicator contacting an image recording material, and which applies the image forming solution to the image recording material by moving relatively to the image recording material while contacting the image recording material, comprising the steps of: (a) forming the applicators as a substantial column on the whole by extrusion molding such that first regions, to which image forming solution is supplied and which have a large average porosity, are positioned at a central portion and second regions, which contact image recording materials and have a smaller average porosity than the first region, are positioned at a periphery of the first regions; and (b) after step (a), dividing the substantial column in two along an axial center of the substantial column such that the second regions are at symmetrical positions and the first regions are exposed.

In accordance with the above-described aspect, applicators are formed as a substantial column on the whole by extrusion molding. Thereafter, the substantial column is simply divided in two along the axial center thereof. As a result, two applicators can be manufactured simultaneously by this simple process. At this time, the first region can be exposed without carrying out a process to remove a portion of the applicator or the like. Accordingly, manufacturing is easy, and the manufacturing costs can be greatly reduced.

A seventh aspect of the present invention is an application method for applying an image forming solution to an image recording material by using the applicator of the above-described first aspect, comprising the steps of: applying the image forming solution in a state in which the image recording material is heated to a predetermined temperature; and squeezing and removing excess image forming solution applied to the image recording material.

DESCRIPTION OF THE PREFERRED EMBODIMENTS

Figure 3:
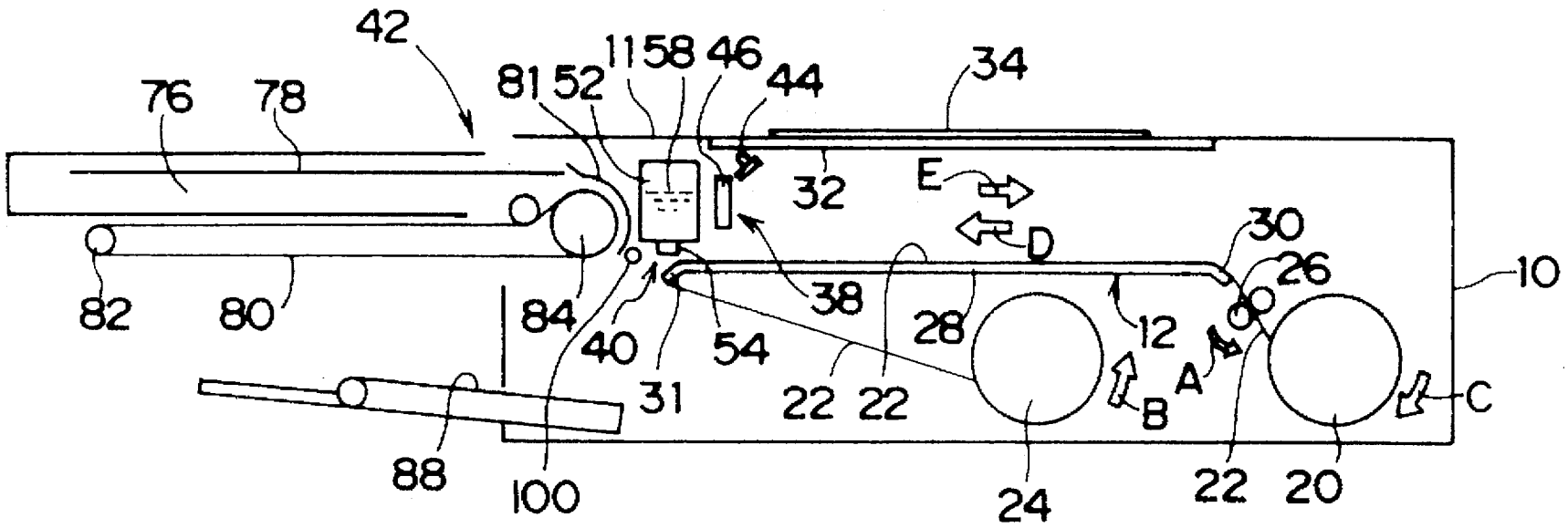
FIG. 3 is a view illustrating an image recording device to which the image forming solution applicator and the image forming solution application unit relating to the first embodiment of the present invention are applied, as seen along the moving direction of the application unit.
Figure 4:
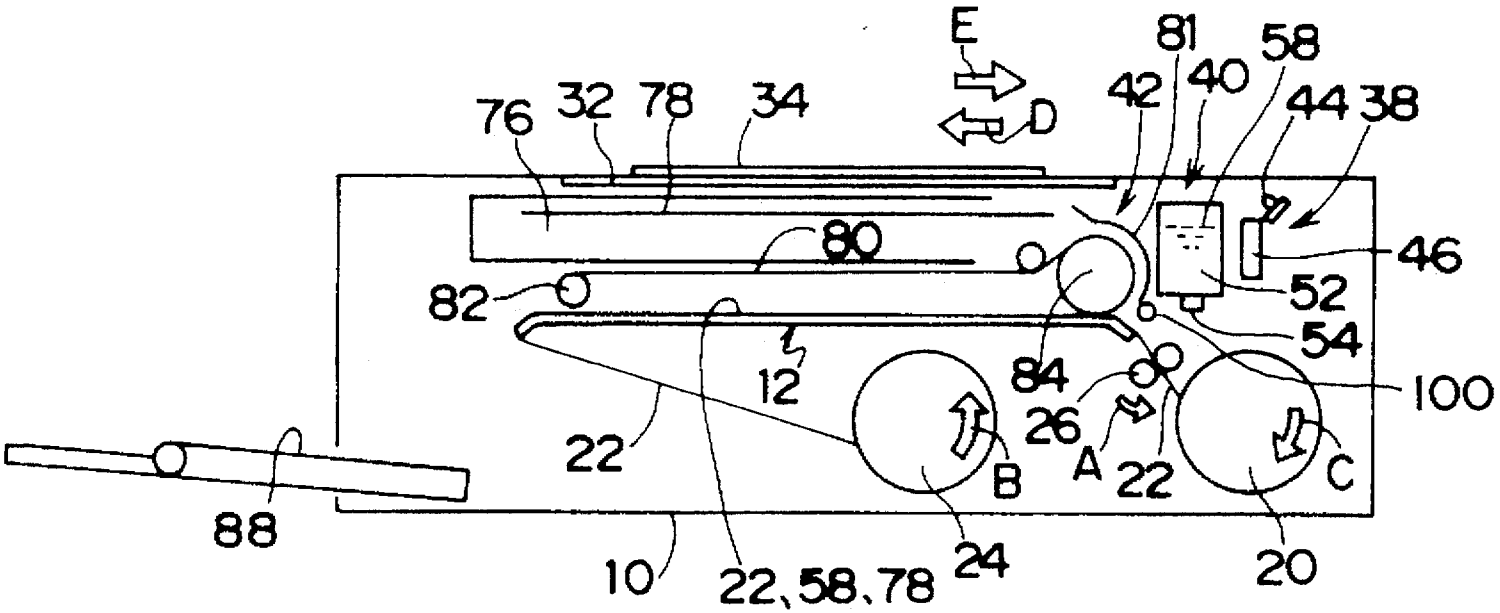
FIG. 4 is a view corresponding to FIG. 3 and illustrating a state in which the application unit relating to the first embodiment of the present invention is at a stop position.

FIGS. 3 and 4 illustrate an image recording device to which are applied an image forming solution applicator 54 and an image forming solution application unit 40 relating to a first embodiment of the present invention.

In the image recording device, a stage 12 is provided in a central portion of an interior of a base stand 10. The stage 12 is shaped as a flat board and is disposed horizontally.

A first roller 20 is provided below the front end side of the stage 12 (the right end side in FIG. 3). A heat development photosensitive material (image recording material) 22, which serves as a photosensitive material and will be referred to hereinafter as "photosensitive material 22", is taken up onto the first roller 20 so as to be accommodated in a roll-form. The photosensitive material 22 includes, on a substrate, a photosensitive silver halide, a binder, a dye providing substance, and a reducing agent. As will be described later, in a state in which the photosensitive material 22 is pulled out from the first roller 20 and held horizontally on the stage 12, the photosensitive surface thereof faces upward.

A second roller 24 is disposed beneath the stage 12 in a vicinity of the first roller 20. The photosensitive material 22, which has been pulled out from the first roller 20 and extends across the stage 12 from the front end to the rear end (the left end in FIG. 3) thereof, is taken up onto the second roller 24. Nip rollers 26 are disposed between the front end of the stage 12 and the first roller 20. If the nip rollers 26 are driven to rotate in the direction of arrow A and the second roller 24 is driven to rotate in the direction of arrow B, as the first roller 20 rotates in the direction of arrow C, the photosensitive material 22 is pulled out from the first roller 20, moves on the stage 12 in the direction of arrow D (from the front end toward the rear end of the stage 12), and is pulled and taken up by the second roller 24.

In this way, the photosensitive material 22 can be pulled out from the first roller 20 and taken up onto the second roller 24 such that a predetermined length thereof is supplied onto the stage 12.

The top surface of the stage includes a planar portion 28, which is a horizontal flat surface, and inclined portions 30, 31 at which the top surface inclines downwardly at the front and rear end portions of the stage 12. During exposure and the like which will be described later, the photosensitive material 22 is held on the stage with a predetermined amount of the photosensitive material 22 positioned on the planar portion 28 and with the photosensitive material 22 pulled along the inclined portions 30, 31, so that the planarity of the predetermined length to the photosensitive material 22 along the top surface of the planar portion 28 is maintained and the predetermined length of the photosensitive material 22 does not become slack.

A document stand 32 is fit above the stage 12 on a base stand top surface 11 so as to oppose the stage 12. The document stand 32 is formed by a transparent plate. A document 34 is placed and held on the document stand 32.

An exposure unit 38, an application unit 40 and a superposing unit 42 are respectively provided so as to be freely movable reciprocally along the front-and-back directions of the stage 12 between the document stand 32 and the stage 12. The respective units advance (the advancing direction is the direction of arrow E) from standby positions (the positions illustrated in FIG. 3) at which the units 38, 40, 42 are disposed in order so as to extend from the rear end of the stage to a region off of the stage 12, to stop positions (the positions illustrated in FIG. 4), at which the units 38, 40, 42 are disposed in order so as to pass beyond the front end of the stage 12 and extend to the stage 12 from a region off of the stage 12. Conversely, the respective units 38, 40, 42 can withdraw (the withdrawing direction is the direction of arrow D) from the stop positions to the standby positions.

The exposure unit 38 is equipped with a light source 44 and a SELFOC lens (lens array) 46. The light from the light source 44 is irradiated toward the document 34. The irradiated light is linear along a direction parallel to the document 34 and orthogonal to the moving direction of the exposure unit 38 (the front-and-back directions of the stage 12), i.e., the irradiated light is linear along directions orthogonal to the surface of the drawing of FIG. 3. The irradiated light is reflected at the document 34, and the reflected light is exposed by the SELFOC lens 46 in a slit-like form onto the photosensitive material 22. Due to the exposure unit 38 advancing from the standby position to the stop position, the image of the document 34 is successively scan-exposed onto the photosensitive material 22.

Figure 1:
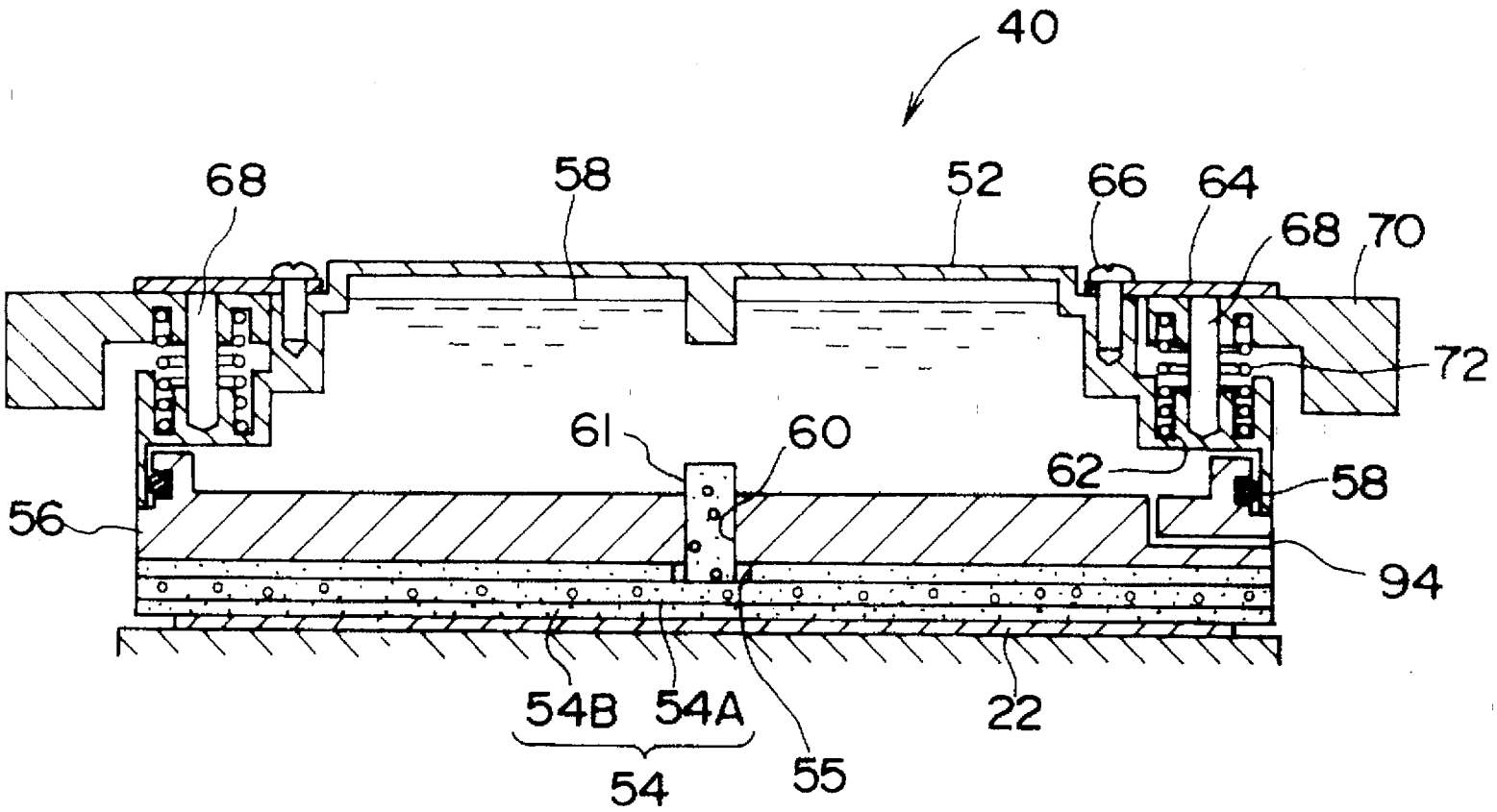
FIG. 1 is a longitudinal sectional view illustrating an image forming solution application unit relating to a first embodiment of the present invention, as seen along a moving direction of the application unit.

As illustrated in detail in FIG. 1, the application unit 40 is structured such that an applicator 54 is provided at the bottom of a tank (container) 52. The tank 52 is shaped as a rectangular box which is parallel to the photosensitive material 22 and which is elongated in a direction orthogonal to the front-and-back directions of the stage 12. The tank 52 is closed via an O-ring 59 by a cover 56 which forms the tank bottom, such that the interior of the tank 52 is sealed. A transfer assistant (image forming solution) such as water 58 or the like is filled within the tank 52. The applicator 54 is formed so as to be elongated along the longitudinal direction of the container 52, and is fixed to the outer side of the cover 56 (the cover bottom surface) so as to extend to both transverse direction ends of the photosensitive material 22. A communicating/supplying portion 60 is formed in the central portion of the cover 56. A liquid introducing member 61 is provided in the communicating/supplying portion 60. The liquid introducing member 61 is formed of an absorbent material such as sponge, felt or the like. One end of the liquid introducing member 61 is positioned within the tank 52, whereas the other end is connected to the applicator 54. In this way, water within the tank 52 is, through the liquid introducing member 61, absorbed and held by the applicator 54.

The upper portions of the longitudinal direction ends of the tank 52 are notched so as to form steps 62. A supporting portion 64 is fastened by a bolt 66 to the upper end of the tank 52 and projects so as to oppose the step 62. An engagement shaft 68 extends in upward and downward directions between the supporting portion 64 and the step 62. One end portion of an operation block 70 is fit with the engagement shaft 68. A coil spring 72 is fit between the operation block 70 and the step 62. The coil spring 72 urges the operation block 70 to abut the supporting portion 64. A plunger of an unillustrated solenoid is connected to the other end portion of the operation block 70. For example, the operation block 70 is lowered by electric power being supplied to the solenoid, and is raised by the supply of electric power to the solenoid being stopped. At the raised positions of the operation blocks 70, the applicator 54 is separated from the photosensitive material 22. When the operation blocks 70 are lowered, the tank 52 is lowered. The amount by which the operation blocks 70 are lowered is greater than the interval between the applicator 54 and the photosensitive material 22 at the raised positions of the operation blocks 70. At the lowered positions of the operation blocks 70, the applicator 54 is pushed against the photosensitive material 22 by the urging force of the coil springs 72 so as to contact the photosensitive material 22. For example, if the free height of the applicator 54 is 4 mm, the applicator 54 is pushed against the photosensitive material 22 so as to be compressed by 1.5 mm at the lowered positions of the operation blocks 70. When the applicator 54 contacts the photosensitive material 22, the water which has been absorbed and held by the applicator 54 is pressed out, and the pressed-out water forms a pool of water at the periphery of the line of contact between the photosensitive material 22 and the elastically deformed applicator 54. Further, by the application unit 40 advancing in this state, water 58 is successively applied to the exposed photosensitive material 22.

After application, the operation blocks 70 are raised, the elastic deformation of the applicator 54 is cancelled, and the applicator 54 is separated from the surface of the photosensitive material 22. As the elastic deformation is cancelled, the water which had formed a pool is absorbed by the applicator 54, and water within the tank 52 is, via the liquid introducing member 61, also absorbed by the applicator 54, so that the applicator 54 returns to the preapplication water holding state.

An air hole 94 is provided in the cover 56. One end of the air hole 94 is open at the inside of the tank 52, whereas the other end is open at the side surface of the cover 56. In this way, the interior of the tank 52 directly communicates with the exterior (i.e., with the outside air) due to the air hole 94. The air hole 94 is used for the introduction of outside air in accordance with the decrease in pressure within the tank 52 which accompanies the reduction in the amount of water within the tank 52.

The structure of the applicator 54 will now be described in detail.

Figure 2B:
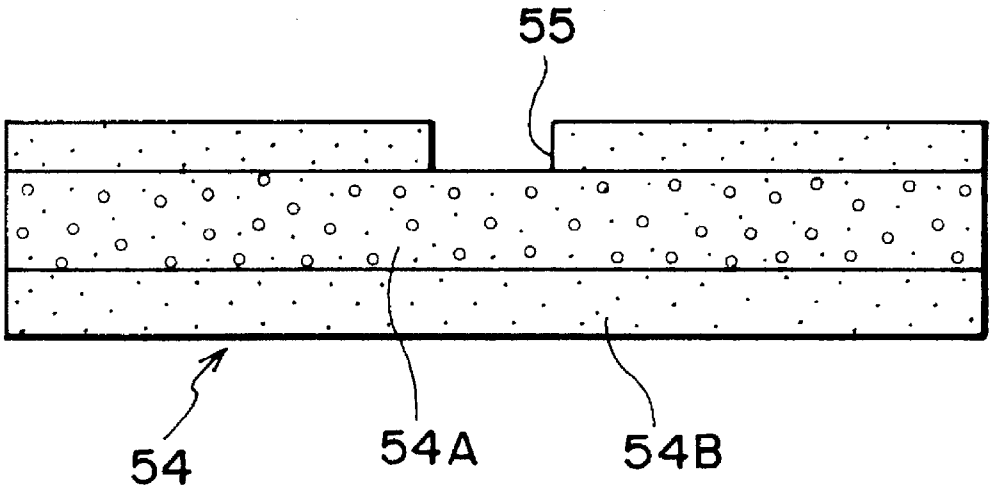
FIG. 2B is a schematic sectional view in a longitudinal direction of the image forming solution applicator relating to the first embodiment of the present invention.
Figure 2A:
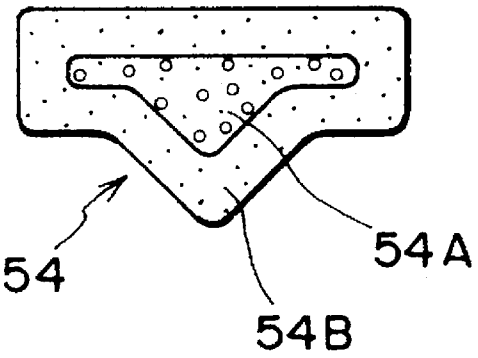
FIG. 2A is a schematic sectional view in a transverse direction of an image forming solution applicator relating to the first embodiment of the present invention.

FIGS. 2A and 2B are schematic sectional views of the applicator 54. The applicator 54 is formed of a flexible, porous body having continuous air cavities, such as a sponge or the like, and is able to absorb and hold the water 58 supplied from an external portion. The applicator 54 is elongated so as to extend over the longitudinal direction dimension of the tank 52. When viewed from the longitudinal direction, as illustrated in FIG. 2A, the applicator 54 has on the whole a substantially inverted isosceles triangular configuration. The base side portion of the triangle is positioned at the tank 52 side such that the vertex portion of the triangle abuts the photosensitive material 22. In this way, the water 58 can be applied to the photosensitive material 22.

The average porosity of the air cavities (foaming) of a central portion 54A of the applicator 54 is greater than that of an outer peripheral portion 54B. (The hole diameters may be compared by, for example, the bubble point method.) For example, the average porosity of the central portion 54A is optimally 100 μ to 400 μ, whereas the average porosity of the outer peripheral portion 54B is optimally 10 μ to 200 μ. As a result, it is easy for the water 58 to flow (penetrate) into the outer peripheral portion 54B from the central portion 54A. The longitudinal direction central portion of the upper portion of the applicator 54 (the outer peripheral portion 54B) is partially cut away so as to form a fit-in portion 55 such that the central portion 54A is exposed. The liquid introducing member 61 is fit into the fit-in portion 55 and is directly connected to the central portion 54A so that the water 58 within the tank 52 is directly supplied to the central portion 54A.

Both longitudinal direction end surfaces of the central portion 54A of the applicator 54 are not covered by the outer peripheral portion 54B and are exposed to the exterior. As a result, when water 58 is supplied to the central portion 54A via the liquid introducing member 61, the air bubbles remaining in the interior portion come out directly from the both end surfaces.

In the first embodiment (FIGS. 1 and 2), the boundary between the central portion 54A and the outer peripheral portion 54B of the applicator 54 is distinct so that the central portion 54A and the outer peripheral portion 54B are formed as two separate layers. However, this boundary need not be distinct, and the average porosity may change along a continuum.

The application unit 40 structured as described above begins to advance after the exposure unit 38 advances. The water 58 is successively applied to the photosensitive material 22 by the application unit 40 advancing with the applicator 54 contacting the photosensitive material 22. At this time, a squeeze roller 100 provided beneath the application unit 40 moves synchronously with the movement of the application unit 40 so as to squeeze the excess water applied to the photosensitive material 22.

The superposing unit 42 is provided with a magazine 76 in which image receiving materials 78 are cut to predetermined lengths and stacked so as to be accommodated parallel to the stage 12. One of the surfaces of the image receiving material 78 is an image forming surface. A dye-fixing material having mordant is applied to the image forming surface of the image receiving material 78. In their accommodated state, the image receiving materials 78 are stacked with the image forming surfaces thereof facing upward. Beneath the magazine 76, an endless belt 80 is entrained around rollers 82, 84. A guide portion 81 is provided at the outer periphery of the roller 84 which is at the stage 12 side when the superposing unit 42 is at the standby position.

The superposing unit 42 begins to advance after the application unit 40 and the squeeze roller 100 advance. As the superposing unit 42 advances, the endless belt 80 reaches the region above the stage 12 and travels clockwise in FIG. 1 above the stage 12 in accordance with the advance of the superposing unit 42. As the endless belt 80 travels, the image receiving material 78 within the magazine 76 is pulled out from the magazine 76 and inverted by the guide portion 81. The pulled-out end thereof contacts the photosensitive material 22. Thereafter, as the superposing unit 42 moves, the image receiving material 78 is superposed on the photosensitive material 22 successively toward the front end of the stage 12 such that the image receiving material 78 is nipped between the endless belt 80 and the photosensitive material 22. At this time, the rigidity of the image receiving material 78 contributes to the tight fit between the image receiving material 78 and the photosensitive material 22.

The stage 12 is heated, and in this heated state, after the above-described exposure, water application and squeezing are effected, superposing is carried out and heat development transfer is effected. More specifically, mobile dyes of the photosensitive material 22 are released, and simultaneously, the dyes are transferred to the dye-fixing layer of the image receiving material 78 so that an image is obtained on the image receiving material 78.

After heat development transfer, the photosensitive material 22 is moved a predetermined amount in the direction of arrow D and, together with the image receiving material 78, is discharged to a region off of the stage 12 from the rear end of the stage 12.

At the time of this discharging, the image receiving material 78 is peeled from the photosensitive material 22 and is stacked in a discharge tray 88.

Thereafter, the exposure unit 38, the application unit 40, and the superposing unit 42 are withdrawn to their standby positions, and can be prepared for the next exposure or the like.

In accordance with the above-described structure, the water 58 within the tank 52 is directly supplied to the central portion 54A of the applicator 54 via the liquid introducing member 61 (i.e., the water 58 is supplied directly to the region having a large average porosity). The water 58 which has been supplied and absorbed flows out from the applicator 54 to the photosensitive material 22 due to the outer peripheral portion 54B of the applicator 54 contacting the photosensitive material 22. Further, the applicator 54 is moved together with the tank 52 relatively to the photosensitive material 22 along the photosensitive material 22 with the applicator 54 pressed against the photosensitive material 22, so that the water 58 is applied to the photosensitive material 22.

Here, in the applicator 54, the average porosity of the central portion 54A to which the water 58 is supplied is greater than the average porosity of the outer peripheral portion 54B which contacts the photosensitive material 22. Therefore, the supplied water 58 smoothly and rapidly penetrates into the applicator 54 due to capillary action, and is absorbed quickly and held stably. Accordingly, uniform application of the water 58 onto the photosensitive material 22 is made possible, and a high quality image is obtained.

Further, in the application unit 40, the water 58 is directly supplied by the liquid introducing member 61 to the central portion 54A which has the largest average porosity among the portions of the applicator 54. Therefore, the supplied water 58 penetrates smoothly and rapidly into the applicator 54, and is absorbed quickly and held stably. Thus, uniform application of the water 58 is made possible for this reason as well.

Moreover, both longitudinal direction ends of the central portion 54A of the applicator 54 are not covered by the outer peripheral portion 54B and are exposed to the exterior. Therefore, when the water 58 is supplied to the central portion 54A via the liquid introducing member 61, the air bubbles remaining in the interior exit directly from the both end surfaces. Accordingly, when the water 58 is supplied to the applicator 54 from the tank 52, the air bubbles remaining within the applicator 54 are quickly discharged to the exterior as the water 58 is supplied. As a result, the absorption and retention of the water 58 into the applicator 54 is not impeded, and the water 58 penetrates smoothly and rapidly into the applicator 54, and is quickly absorbed and stably held thereby.

When the water 58 is supplied to the applicator 54 and flows out from the applicator 54 to the photosensitive material 22, as the water 58 flows out, the amount of water 58 within the tank 52 decreases and the pressure within the tank 52 decreases. However, the decrease in pressure is compensated for by outside air being introduced into the tank 52 via the air hole 94. In this case, the outflow of water 58 into the applicator 54 is carried out by the liquid introducing member 61 alone, and the introduction of outside air due to the reduction in pressure within the tank 52 is carried out by the air hole 94 alone. Therefore, the liquid introducing member 61 and the air hole 94 do not interfere with each other, and the water 58 within the tank 52 is always supplied stably to the applicator 54.

Figure 5B:
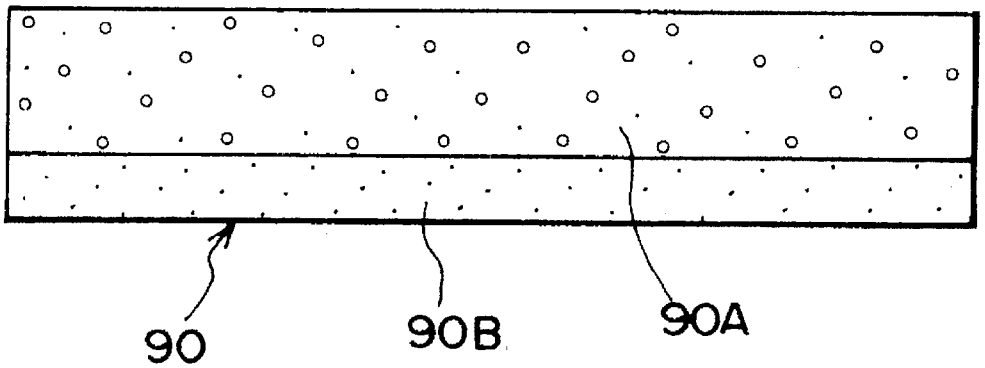
FIG. 5B is a schematic sectional view corresponding to FIG. 2B and illustrating the image forming solution applicator relating to the second embodiment of the present invention.
Figure 5A:
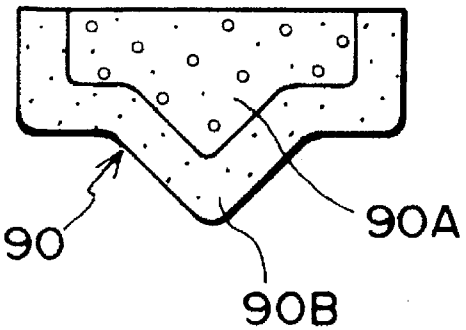
FIG. 5A is a schematic sectional view corresponding to FIG. 2A and illustrating an image forming solution applicator relating to a second embodiment of the present invention.

Next, a second embodiment of the present invention will be described on the basis of FIGS. 5 and 6.

An applicator 90 is structured such that only the lower surface side of a central portion 90A is covered by an outer peripheral surface 90B. The central portion 90A and the top portion of the outer peripheral portion 90B are exposed. In this applicator 90 as well, the average porosity of the air cavities (foaming) of the central portion 90A is greater than that of the outer peripheral portion 90B. As a result, it is easy for the water 58 to flow (penetrate) from the central portion 90A into the outer peripheral portion 90B.

In the applicator 90, the supplied water 58 penetrates into the interior of the applicator 90 smoothly and rapidly due to capillary action, and is always quickly absorbed and stably held thereby. Accordingly, uniform application of the water 58 onto the photosensitive material 22 is made possible, and a high quality image is obtained.

The respective configurations of the applicator 54 and the applicator 90 of the above-described embodiments can be obtained by extrusion molding. It is optimal to manufacture the applicator 90 in particular by using the method (means) which will be described hereinafter.

Figure 6:
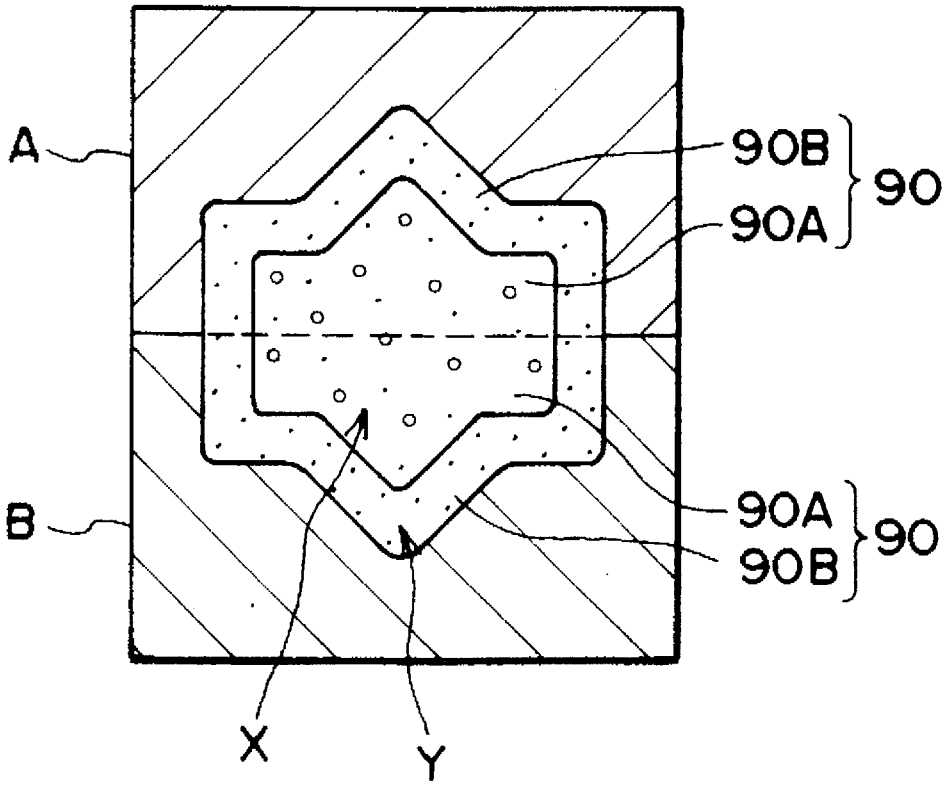
FIG. 6 is a schematic sectional view illustrating a method of manufacturing the image forming solution applicator relating to the second embodiment of the present invention.

As illustrated in FIG. 6, applicators, which are substantially columnar on the whole and which have an outer peripheral portion Y at the periphery of a central portion X, can be extrusion molded by using molds A, B. Thereafter, the molded applicators are cut in two along the axial center of the column (the broken line in FIG. 6) such that the end portions of the outer peripheral portions Y which contact the photosensitive material 22 are at symmetrical positions. In this way, two applicators 90 respectively having a central portion 90A and an outer peripheral portion 90B can be formed simultaneously.

In accordance with the above described method of manufacturing, after the substantial column is formed by extrusion molding, the column is cut in two along the axial center thereof. Accordingly, two applicators 90 can be manufactured simultaneously by these simple processes. Here, the central portion 90A (i.e., the region of the applicator 90 which is most rough or has the highest porosity) can be exposed without any processes such as removing portions of the applicator 90 being carried out. Accordingly, manufacturing is easy, and a marked reduction in manufacturing costs can be achieved.

In the above described embodiments, the applicator 54 and the applicator 90 are formed with two layers which are the central portion 54A and the outer peripheral portion 54B and the central portion 90A and the outer peripheral portion 90B, respectively. However, the applicators need not be formed with strictly two layers as described above.

More specifically, it suffices if the average porosity of the side to which the water 58 is supplied is greater than that at the side which contacts the photosensitive material 22. The average porosity may continuously and gradually become larger from the outer peripheral portion toward the central portion. In this case as well, the supplied water 58 smoothly and rapidly penetrates into the applicator 54 due to capillary action, and is always absorbed swiftly and retained stably.

The material of the applicator 54 and the applicator 90 is not limited to a sponge, and may be a puff, a synthetic foamed body having continuous air bubbles, felt or the like. Any material which can absorb and hold the water within the tank 52 and which allows the water to flow out by contacting the photosensitive material 22 or, for example, by being pressed against the photosensitive material 22, may be used as the material for the applicator.

The present invention is not limited to the above-described embodiments, and various modifications thereof are possible. For example, in the above-described embodiments, the exposure onto the photosensitive material 22, the application of water 58 to the photosensitive material 22, the superposition of the image receiving material 78 with the photosensitive material 22, and the heat development transfer are all carried out on a common stage 12 in order to allow for a more compact apparatus. However, the present invention is not limited to the same, and each of these processes can be carried out on a respectively different stage.

Further, in the above embodiments, the water 58 is applied onto the photosensitive material 22. However, the image recording material is not limited to the photosensitive material 22, and may be another material such as an image receiving material or the like.

Water, for example, may be used as the image forming solution of the present invention. (In the above-described embodiments, the water 58 is used as the image forming solution.) The water used in the present invention is not limited to so-called demineralized water, and includes water in the general sense. Further, a mixed solution of demineralized water and a low boiling point solvent such as methanol, DMF, acetone, di-isobutyl ketone or the like may be used as the image forming solution. Moreover, solutions including image formation accelerators, antifoggants, developing terminators, hydrophilic heat solvents, or the like may be used.

In the above-described embodiments, application is carried out with the photosensitive material 22 fixed and the application unit 40 moving. However, conversely, application may be carried out with the application unit 40 fixed and the photosensitive material 22 moving.

A so-called heat development photosensitive material, in which a latent image obtained by image-wise exposure is heat-development-transferred onto an image receiving material under the presence of an image forming solution so as to obtain a visible image, may be used as the photosensitive material in the present invention. The photosensitive material 22 in the above embodiments is such a heat development photosensitive material.

The heat development photosensitive material basically includes, on a substrate, a photosensitive silver halide, a reducing agent, a binder, and a dye providing compound. (There are also cases in which the reducing agent is used as the dye providing compound.) If needed, the photosensitive material can contain an organometallic base oxidizing agent or the like.

The heat development photosensitive material may be a material which provides a negative image due to exposure or a material which provides a positive image due to exposure. A method utilizing a direct positive emulsion as the silver halide emulsion (there are two types of this method: a method using a nucleus forming agent and a light fogging method), or a method utilizing a dye providing compound which releases a dye image which is diffusible positively can be used as a method of providing a positive image.

The photosensitive materials disclosed in, for example, JP-A (Japanese Patent Application Laid-Open) No. 6-161070 and JP-A No. 6-289555 can be used as the heat development photosensitive materials of the method of providing a positive image. The photosensitive materials disclosed in, for example, JP-A No. 5-181246 and JP-A No. 6-242546 can be used as the heat development photosensitive materials of the method of providing a negative image.

What is claimed is:

1. An image forming solution applicator which is formed of a flexible, porous material, and which can absorb and hold an image forming solution supplied from an external portion, and from which the absorbed and held image forming solution flows out due to said applicator contacting an image recording material, and which applies the image forming solution to the image recording material by moving relatively to the image recording material while contacting the image recording material, wherein an average porosity of a first region of said applicator, to which first region the image forming solution is supplied, is greater than an average porosity of a second region of said applicator, which second region contacts the image recording material.

2. An image forming solution applicator according to claim 1, wherein said applicator is an elongated body which extends in a direction substantially orthogonal to a direction in which said applicator moves while contacting the image recording material, the elongated body being formed by a first portion which is elongated and includes said first region and a second portion which is elongated and includes said second region, and when the image forming solution is supplied from the external portion, air bubbles remaining in an interior portion of said applicator are expelled from longitudinal direction end surfaces of said first portion and said second portion.

3. An image forming solution applicator according to claim 2, wherein longitudinally-extending peripheral surfaces of said first portion, except for said first region, are covered by said second portion.

4. An image forming solution applicator according to claim 2, wherein longitudinally-extending peripheral surfaces of said first portion, except for a surface including said first region, are covered by said second portion.

5. An image forming solution applicator according to claim 2, wherein said second portion has a projecting portion which extends along a longitudinal direction of said second portion, and which projects toward the image recording material and contacts the image recording material.

6. An image forming solution applicator according to claim 5, wherein a transverse direction cross-section of said projecting portion is substantially triangular.

7. An application method for applying an image forming solution to an image recording material by using the applicator according to claim 1, comprising the steps of:

applying the image forming solution in a state in which the image recording material is heated to a predetermined temperature; and squeezing and removing excess image forming solution applied to the image recording material.

8. An image forming solution application unit, comprising:

a container movable relatively to an image recording material along the image recording material, and housing an image forming solution for obtaining an image on the image recording material, and having, at a bottom wall of said container which bottom wall opposes the image recording material, an applicator for applying the image forming solution to the image recording material; and a communicating/supplying portion provided at the bottom wall of said container and supplying the image forming solution within said container directly to said applicator, wherein said applicator is formed of a flexible, porous material and can absorb and hold the image forming solution supplied from said communicating/supplying portion, the absorbed and held image forming solution flowing out from said applicator due to said applicator contacting the image recording material, said applicator applying the image forming solution to the image recording material by moving relatively to the image recording material while contacting the image recording material, and an average porosity of a first region of said applicator, to which first region the image forming solution is supplied, is greater than an average porosity of a second region of said applicator, which second region contacts the image recording material.

9. An image forming solution application unit according to claim 8, wherein said applicator is an elongated body which extends in a direction substantially orthogonal to a direction of relative movement of said applicator and the image recording material, the elongated body being formed by a first portion which is elongated and includes said first region and a second portion which is elongated and includes said second region, and when the image forming solution is supplied from said communicating/supplying portion, air bubbles remaining in an interior portion of said applicator are expelled from longitudinal direction end surfaces of said first portion and said second portion.

10. An image forming solution application unit according to claim 9, wherein said communicating/supplying portion has a liquid introducing member for supplying the image forming solution to said applicator.

11. An image forming solution application unit according to claim 8, wherein said container has an air hole which is formed so as to introduce outside air into said container so as to handle a reduction in pressure within said container which accompanies supply of the image forming solution within said container to said applicator.

12. An image forming solution application unit according to claim 9, wherein said container has an air hole which is formed so as to introduce outside air into said container so as to handle a reduction in pressure within said container which accompanies supply of the image forming solution within said container to said applicator.

13. An image forming solution application unit according to claim 10, wherein said container has an air hole which is formed so as to introduce outside air into said container so as to handle a reduction in pressure within said container which accompanies supply of the image forming solution within said container to said applicator.

14. An image forming solution application unit according to claim 9, wherein in said applicator, longitudinally-extending peripheral surfaces of said first portion, except for said first region, are covered by said second portion.

15. An image forming solution application unit according to claim 9, wherein in said applicator, longitudinally-extending peripheral surfaces of said first portion, except for a surface including said first region, are covered by said second portion.

16. An image forming solution application unit according to claim 9, wherein said second portion of said applicator has a projecting portion which extends along a longitudinal direction of said second portion, and which projects toward the image recording material and contacts the image recording material.

17. An image forming solution application unit according to claim 16, wherein a transverse direction cross-section of said projecting portion is substantially triangular.

18. A method of manufacturing an image forming solution applicator which is formed of a flexible, porous material, and which can absorb and hold an image forming solution supplied from an external portion, and from which the absorbed and held image forming solution flows out due to said applicator contacting an image recording material, and which applies the image forming solution to the image recording material by moving relatively to the image recording material while contacting the image recording material, comprising the steps of:

(a) forming said applicators as a substantial column on the whole by extrusion molding such that first regions, to which image forming solution is supplied and which have a large average porosity, are positioned at a central portion and second regions, which contact image recording materials and have a smaller average porosity than said first region, are positioned at a periphery of said first regions; and (b) after said step (a), dividing said substantial column in two along an axial center of said substantial column such that said second regions are at symmetrical positions and said first regions are exposed.

19. A method of manufacturing an image forming solution applicator according to claim 18, wherein said substantial column is formed in said step (a) so as to be structured by first portions which are elongated and include said first regions and second portions which are elongated and include said second regions, and so that longitudinal direction end surfaces of said first portions and said second portions are exposed.

20. A method of manufacturing an image forming solution applicator according to claim 19, wherein in said step (a), a projection is formed at each of said second regions so that when said substantial column is divided in two in said step (b), each of said second portions has a projection along a longitudinal direction of said second portion.

21. A method of manufacturing an image forming solution applicator according to claim 20, wherein a transverse direction cross-section of said projection is substantially triangular.

* * * * *